United States Patent [19]

Sheldon

[11] 4,082,306

[45] Apr. 4, 1978

[54] TORSION BAR SKATEBOARD

[76] Inventor: Gregg Sheldon, 330 Sunnyside Rd., Temple Terrace, Fla. 33617

[21] Appl. No.: 749,022

[22] Filed: Dec. 9, 1976

[51] Int. Cl.[2] ..... A63C 1/28

[52] U.S. Cl. ..... 280/87.04 A; 280/11.28

[58] Field of Search ..... 280/87.04 A, 87.04 R, 280/84.03, 87.01, 11.19, 11.27, 11.28, 11.23, 1.1 R, 11.1 R

[56] References Cited

U.S. PATENT DOCUMENTS

| | | | |
|---|---|---|---|
| 1,377,948 | 5/1921 | Wacker | 280/87.04 R |
| 1,703,936 | 3/1929 | Jervoise | 280/11.23 |
| 2,027,254 | 1/1936 | Vogt | 280/87.04 A |
| 2,162,128 | 6/1939 | Shoemaker | 280/11.19 |
| 2,330,147 | 9/1943 | Rodriguez | 280/87.04 A |
| 2,664,294 | 12/1953 | Kleinman | 280/11.27 |
| 3,023,022 | 2/1962 | Boyden | 280/87.04 A |
| 3,891,225 | 6/1975 | Sessa | 280/87.04 R |

*Primary Examiner*—David M. Mitchell
*Attorney, Agent, or Firm*—Willard J. Hodges, Jr.

[57] ABSTRACT

An improved skateboard having a front platform separate and spaced from a rear platform. To each platform is attached a relatively conventional flexing wheel assembly with axle. In the first species of the invention the base plate of the wheel assemblies has resilient cushions mounted between the base plate of the wheel assemblies and the platforms. A torsion bar interconnects the base of the front wheel assemblies with the base of the rear wheel assemblies permitting rotary flexing between the two wheel assemblies. In the second species of the invention the torsion bar is connected to the pivotal collar of the shaft bushings rather than being connected directly to the base plates. To improve stability a support tubing is attached to the front and rear platforms and surround and encase the torsion bar. The support tubing maintains a front and rear platform in substantially constant spaced relationship.

7 Claims, 4 Drawing Figures

TORSION BAR SKATEBOARD

BACKGROUND OF THE INVENTION

1. Field of the Invention

The invention pertains to an improvement in the art of the toy or sporting device generally referred to as a skateboard.

2. Description of the Prior Art

Skateboards, as presently produced, evolved from a separation of a roller skate in two parts and the attachment of the front and rear wheel assemblies to a board. In recent years, fiberglass and plastics have been used for construction of the platforms and well designed and highly efficient wheels, bearings and associated structure mounted on pivotally flexible mounts have been developed. The area of improvement incorporated in this invention generally pertains to a torsion bar interconnecting the front wheel assemblies and the rear wheel assemblies. To the best knowledge of your applicant no similar structure has heretofore been employed in skateboards. A somewhat related structure appears in U.S Pat. Nos. 1,377,948 to Wacker; 3,667,777 to Enriquez; and 3,891,225 to Sessa.

SUMMARY OF THE INVENTION

The invention comprises an improvement in the art of skateboards and primarily pertains to a more flexible skateboard having improved maneuvering characteristics. The area of the improvement is in the utilization of a laminated torsion bar to interconnect the front and rear wheel assemblies, or trucks, in flexible rotating relationship. This arrangement, in conjunction with utilizing a separate front and rear platform, adds maneuverability to the skateboard permitting sharp turns and better control of the device. A principal object of this invention was to develop a skateboard having improved flexibility and maneuvering characteristics. The conventional skateboard flexes and turns for maneuvers by flexing of the trucks or wheel assemblies on rubber wheel support bushings incorporated in the axle support shaft in cooperation with the wheel pivot pins. In the conventional structure a tilting of the axle on its flexible mount causes the wheels to turn relative to the platform steering the device. The improvement of this invention incorporates separate front and rear platforms and a torsion bar interconnecting the front and rear wheel assemblies which adds to the relative flexibility of the board and permits increased rotatability improving the steering capabilities.

DESCRIPTION OF THE PREFERRED EMBODIMENT

Figure 1:
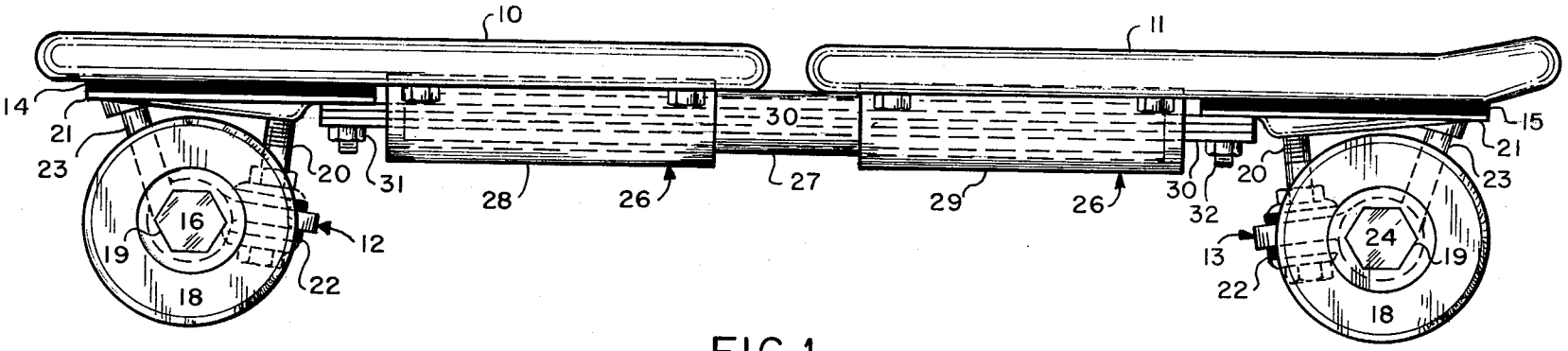
FIG. 1 is a side elevation view of species 1 of the device illustrating the laminated torsion bar attached to the base plate.

For a detailed description of the device attention is invited to the attached drawings wherein each species of the invention is illustrated in detail. Identical reference characters are employed throughout the several views and the following detailed description to illustrate the construction and operation of the preferred embodiment.

Figure 2:
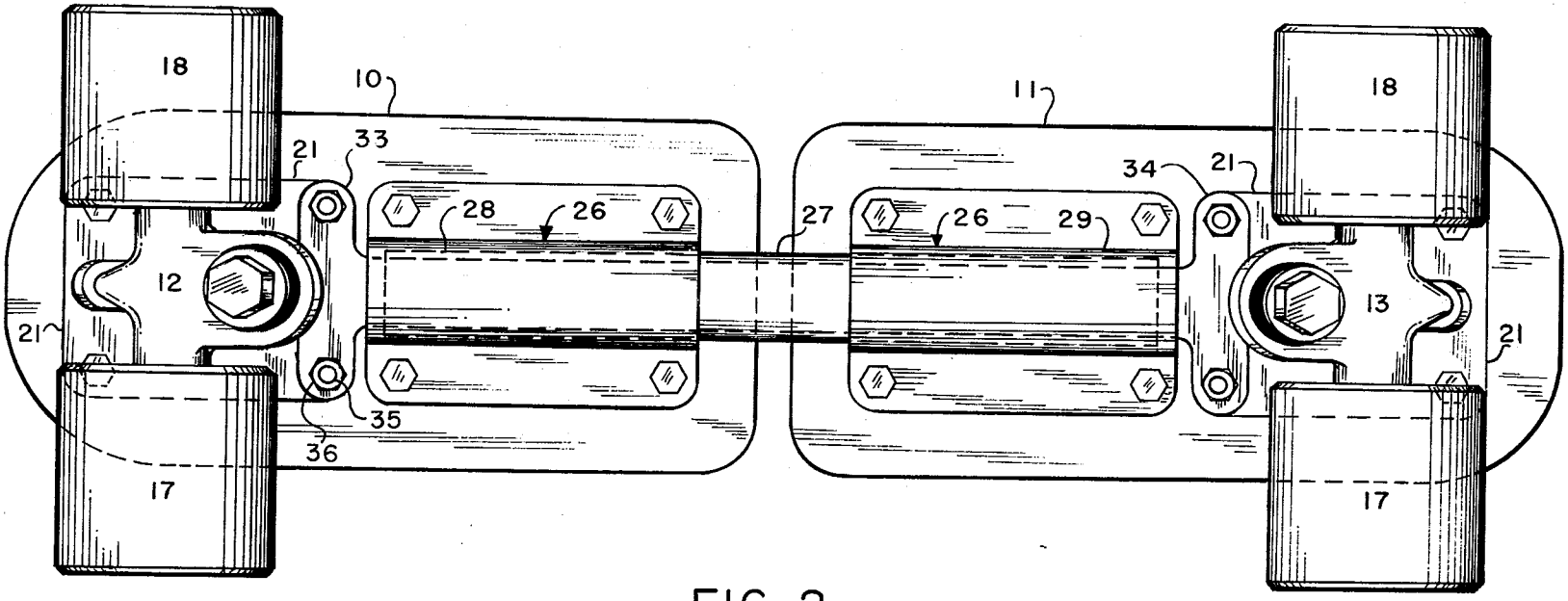
FIG. 2 is a bottom view of species 1 of the device illustrating a method of connecting and stabilizing the torsion bar interconnecting the front and rear wheel assemblies.

The device of species 1 of the invention illustrated in FIG. 1 and FIG. 2 may be constructed utilizing commercially available components adapted to or modified to be incorporated in the combination of this invention. The device of this invention is constructed employing a front platform 10 and a rear platform 11 which are constructed of plastic, wood or other suitable materials. The front wheel assembly 12 and the rear wheel assembly 13 may be of conventional construction and are secured to the front platform 10 and the rear platform 11 in a manner as substantially illustrated in FIGS. 1 and 2. In the device of species 1 of the invention a front wheel assembly cushion 14 and a rear wheel assembly cushion 15 are interposed between the respective wheel assemblies 12 and 13 and the platforms 10 and 11. The wheel assemblies or trucks incorporated in this invention may be of conventional construction and may comprise components readily available at wheel goods or skateboard shops. Such a construction may incorporate a front axle 16 upon which are mounted a right wheel 17 and a left wheel 18 having appropriate bearing means (not shown). The wheels 17 and 18 are secured to the axle 16 by wheel lugs 19. A sturdy axle support shaft 20 projects downward and is integral with or securely attached to the base plate 21. In the usual construction a wheel support shaft bushing 22 is mounted around the axle support shaft 20. This bushing 22 is normally constructed of rubber or some other resilient plastic which permits a flexing of the wheels relative to the axle support shaft 20. Incorporated in the construction of the front wheel assembly 12 and the rear wheel assembly 13 are wheel pivot pins 23. The wheel pivot pin of the front wheel assembly is positioned in front of the front axle support shaft 20 and the rear wheel pivot pin 23 is positioned in rear of the axle support shaft 20 of the rear wheel assembly 13. In the conventional construction the front and rear wheel assemblies 12 and 13 are of identical configuration. The rear wheel assembly 13 incorporates a rear axle 24.

Figure 3:
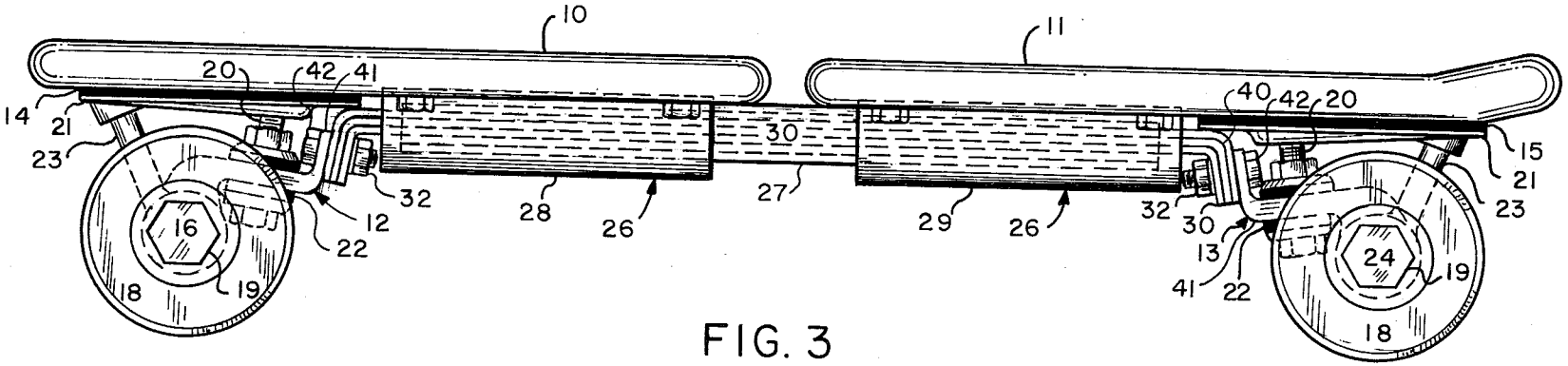
FIG. 3 is a side elevation view of species 2 of the invention illustrating the torsion bar attached to the pivotal collar of the shaft bushing.
Figure 4:
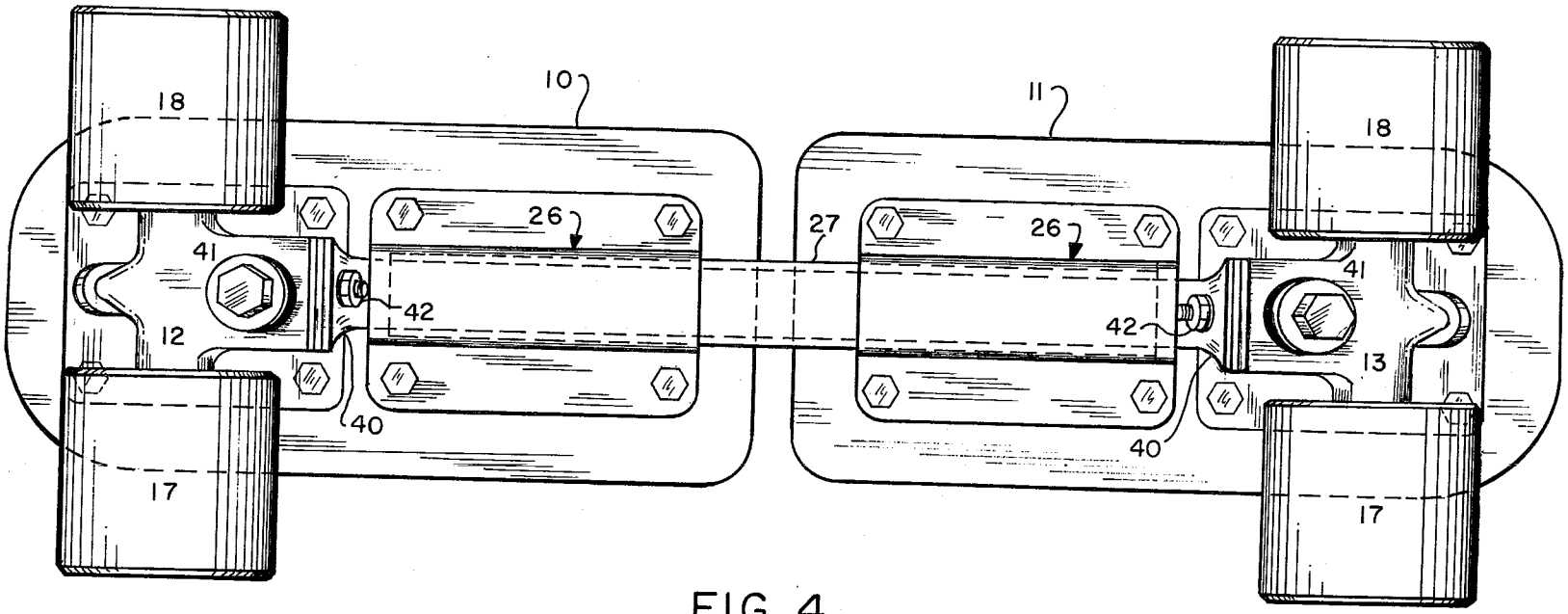
FIG. 4 is a bottom view of species 2 of the device illustrating a method of interconnecting the front and rear wheel assemblies securing the torsion bar to the respective pivotal collars of the front and rear wheel assemblies.

Incorporated in species 1 of the device illustrated in FIGS. 1 and 2 as well as in Species 2 of the device illustrated in FIGS. 3 and 4 various additional components are incorporated in the skateboard adapted to the structure of this invention. A housing for support tubing 26 is securely attached to the bottom of the front platform 10 and rear platform 11. Rotatability mounted and encased by the housing for the support tubing 26 is an elongated support tubing 27. This support tubing should be so secured to the front platform 10 and the rear platform 11 as to permit relative rotation of the two platforms 10 and 11. The preferred construction would ordinarily include a front housing for support tubing 28 to be secured to the front platform 10 and a rear housing for support tubing 29 to be secured to the rear platform 11. Positioned in and encased by the support tubing 27 is a laminated torsion bar 30. The laminated structure is preferred in that it permits varying the thickness of the torsion bar 30 and its flexibility in accordance with desires of the user of the skateboard. The torsion bar 30 is secured to the front wheel assembly 12 by means of a front wheel assembly torsion bracket 31 and likewise the torsion bar 30 is secured to the rear wheel assembly 13 by means of a rear wheel assembly torsion bracket 32. In species 1 of the device as illustrated in FIGS. 1 and 2 a front base plate torsion bar securing means 33 and a rear base plate torsion bar securing means 34 are incorporated in the base plates 21 of the front and rear wheel assemblies 12 and 13. These base plate torsion bar securing means 33 and 34 might well incorporate a securing bolt 35 and a securing nut 36.

For an illustration of the construction of species 2 of the device attention is particularly invited to FIGS. 3 and 4 of the drawings. Modification required in the construction of species 1 as described above consists primarily in the methods of securing the torsion bar 30 to the respective front and rear wheel assemblies 12 and 13. One method of accomplishing this modification would be to construct a torsion bar securing bend 40 at each end of the torsion bar 30. This torsion bar securing bend 40 is attached to a modified construction of the pivotal collar of the shaft bushing 41. This pivotal collar of the shaft bushing 41 is very similar in configuration to the commercially available wheel assembly or trucks of skateboards. The modification in the pivotal collar of the shaft bushing 41 would include a lip-like structrue projecting outward and upward permitting the utilization of a torsion bar securing bolt 42 to secure the torsion bar 30 to the pivotal collar of the shaft bushing 41. The principal area of the invention of the improved skateboard of this device relates to the incorporating of a torsion bar 30 into the overall configuration of the front platform 10, rear platform 11 and the front wheel assemblies 12 and the rear wheel assemblies 13. An object as previously stated is to permit increased flexibility of the wheel assemblies 12 and 13 relative the platforms 10 and 11. This increased flexibility may be accomplished by incorporating thicker, more flexible or resilient front and rear wheel assembly cushions 14 and 15 interposed between the front and rear platforms 10 and 11 and the front and rear wheel assemblies 12 and 13. Another method of increasing flexibility of the wheels would be to utilize a softer or more flexible wheel support shaft bushing 22. This modification of the conventional structure in the combination with the torsion bar 30 accomplishes a main objective of this invention which is to develop a skateboard having increased flexibility and improved maneuverability.

OPERATION OF THE DEVICE

The operation of the device of this invention is considered to be rather self-evident and is in a large measure similar to existing skateboards. The variation in the operation of the device in this invention is accomplished through or by the shifting of weight of the user on the front platform 10 and the rear platform 11 which results in a rotary or twisting moment being applied to the torsion bar 30. This improved structure permits or causes increased maneuverability of the device over the existing art.

The support tubing 27 interconnecting the front platform 10 and the rear platform 11 is rotatably mounted which permits the platforms 10 and 11 to rotate freely biased by the torsion bar 30. This flexibility between the front 10 and rear platform 11 increases maneuverability over conventional skateboards. The front 10 and rear platform 11 are biased to a neutral position; a tilting of either platform imparts a turning movement to the skateboard. The wheel assemblies 13 and 14 function as in a conventional skateboard; the improvement and difference of this invention resides in the dual platforms being flexibly connected by the support tubing 27 and the torsion bar 30 and the associated structure facilitating relative movement of either platform in response to weight or pressure. The device of this invention accordingly, should possess maneuvering attributes and characteristics not present in the skateboards of existing art.

Having described the detail of the construction of the device of this invention in two species, what is desired to be claimed is all modifications or adaptations of the device not departing from the scope of the equivalents of the invention as defined in the appended claims.

I claim:

1. An improved skateboard comprising:

a. a platform means having a forward portion and a separate, spaced rear portion suitably constructed for operably mounting of, b. a front wheel assembly secured to said forward portion, c. a rear wheel assembly spaced from said front wheel assembly secured to said rear portion, and d. an elongated torsion bar mounted underneath said platform means secured to said front wheel assembly, projecting underneath said platform means and secured to said rear wheel assembly said torsion bar twisting throughout its length thereby providing for relatively different tilting movements between said front wheel assembly and said rear wheel assembly.

2. The invention of claim 1:

a. wherein said forward portion comprises:

(1) a front platform upon which is mounted the said front wheel assembly, and said rear portion comprises (2) a rear platform upon which is mounted the said rear wheel assembly, b. a support tubing surrounding said torsion bar, said support tubing being rotatably attached to said front platform and rotatably attached to said rear platform thereby permitting relative rotary movement of the said platforms while maintaining their relative elongated spaced relationship.

3. The invention of claim 1 wherein the said torsion bar is a laminated torsion bar.

4. The invention of claim 2 further comprising:

a. a front housing rotatably securing said support tubing to said front platform, and b. a rear housing rotatably securing said support tubing to said rear platform.

5. The invention of claim 1 further comprising:

a. a front wheel assembly cushion mounted between said platform means and said front wheel assembly, b. a rear wheel assembly cushion mounted between said platform means and said rear wheel assembly, said front and said rear cushions being positioned between the said platform means and a front base plate upon which is mounted said front wheel assembly and a rear base plate upon which is mounted said rear wheel assembly.

6. The invention of claim 1 further comprising:

a. a front wheel assembly torsion bracket securing said torsion bar to the said front wheel assembly, and b. a rear wheel assembly torsion bracket securing said torsion bar to said rear wheel assembly.

7. The invention of claim 5 further comprising:

a. a front base plate torsion bar securing means said torsion bar to front base plate of said wheel assembly, and b. a rear base plate torsion bar securing means securing said torsion bar to rear base plate of said rear wheel assembly.

* * * * *